United States Patent [19]

Niemiec

[11] 4,072,451

[45] Feb. 7, 1978

[54] POWER TRANSMISSION

[75] Inventor: Albin Joseph Niemiec, Sterling Heights, Mich.

[73] Assignee: Sperry Rand Corporation, Troy, Mich.

[21] Appl. No.: 731,277

[22] Filed: Oct. 12, 1976

[51] Int. Cl.[2] ..... F04C 29/00

[52] U.S. Cl. ..... 418/178; 418/133

[58] Field of Search ..... 418/131, 132, 133, 134, 418/135, 149, 178, 179

[56] References Cited

U.S. PATENT DOCUMENTS

| | | | |
|---|---|---|---|
| 3,528,757 | 9/1970 | Ware | 418/178 X |
| 3,545,901 | 12/1970 | Belzner | 418/179 |
| 3,752,609 | 8/1973 | Niemiec et al. | 418/133 |
| 3,791,781 | 2/1974 | Fujiyama et al. | 418/179 |
| 3,892,028 | 1/1975 | Dobler | 418/178 X |

*Primary Examiner*—William L. Freeh
*Assistant Examiner*—Leonard Smith
*Attorney, Agent, or Firm*—Theodore Van Meter

[57] ABSTRACT

In a rotary sliding vane pump having a non-circular cam ring which expands and contracts radially, a cheek plate is clamped against the end face of the cam ring and lies in rubbing contact with the rotor and vanes. The cheek plate has a wearing face of low friction material such as bronze. Unwanted wear between the cheek plate and the cam ring due to its expansion/contraction movements is reduced by the provision of one or more areas of hard metal adjacent the cam ring.

2 Claims, 6 Drawing Figures

POWER TRANSMISSION

In the operation of rotary sliding vane pumps or motors, an example of which is illustrated in the patent to Pettibone et al U.S. Pat. No. 3,792,936 of Feb. 19, 1974 entitled Power Transmission, durability and efficiency are enhanced by the provision of flat cheek plates having wear surfaces of low friction material such as bronze. These cheek plates are clamped between the stationary end plates and the stationary cam ring, the thickness of which is predetermined to allow a desired clearance between the cheek plates and the rotor and vanes to provide an optimum balance between frictional losses and wear on the one hand and fluid leakage or slippage on the other hand. It has been found difficult heretofore, however, to maintain such ideal clearance relationship over long periods of operation, particularly where the unit is subjected to alternate high and low pressure conditions during operation.

The present invention is based upon the discovery that under such intermittent pressure applications, the cam ring partakes of radial expansion and contraction to a sufficient degree to gradually rub away or wear down the surface of the cheek plate which is in contact with the cam ring.

The present invention aims to overcome or reduce this difficulty.

The invention resides in the provision of a rotary sliding vane pump or motor having a body comprising a central cam ring having circular arcs of major and minor diameters alternately spaced around its inner cam surface and connected by ramps along which fluid displacement can occur, said body further comprising end covers, means forming inlet and outlet terminals connected respectively with the ramps, a slotted rotor within the cam ring and carrying radially slidable vanes to traverse the inner cam ring surface, one or more cheek plates interposed between one or both end covers and the rotary vanes and the stationary cam ring, the cheek plate or plates having a wear face of low friction bearing material abutting the rotor, vanes and cam ring, and means for reducing wear between the cheek plate and the cam ring as it radially expands and contracts under intermittent pressure loads comprising an area of contact with the cam ring formed of hard metal.

IN THE DRAWINGS

Figure 1:
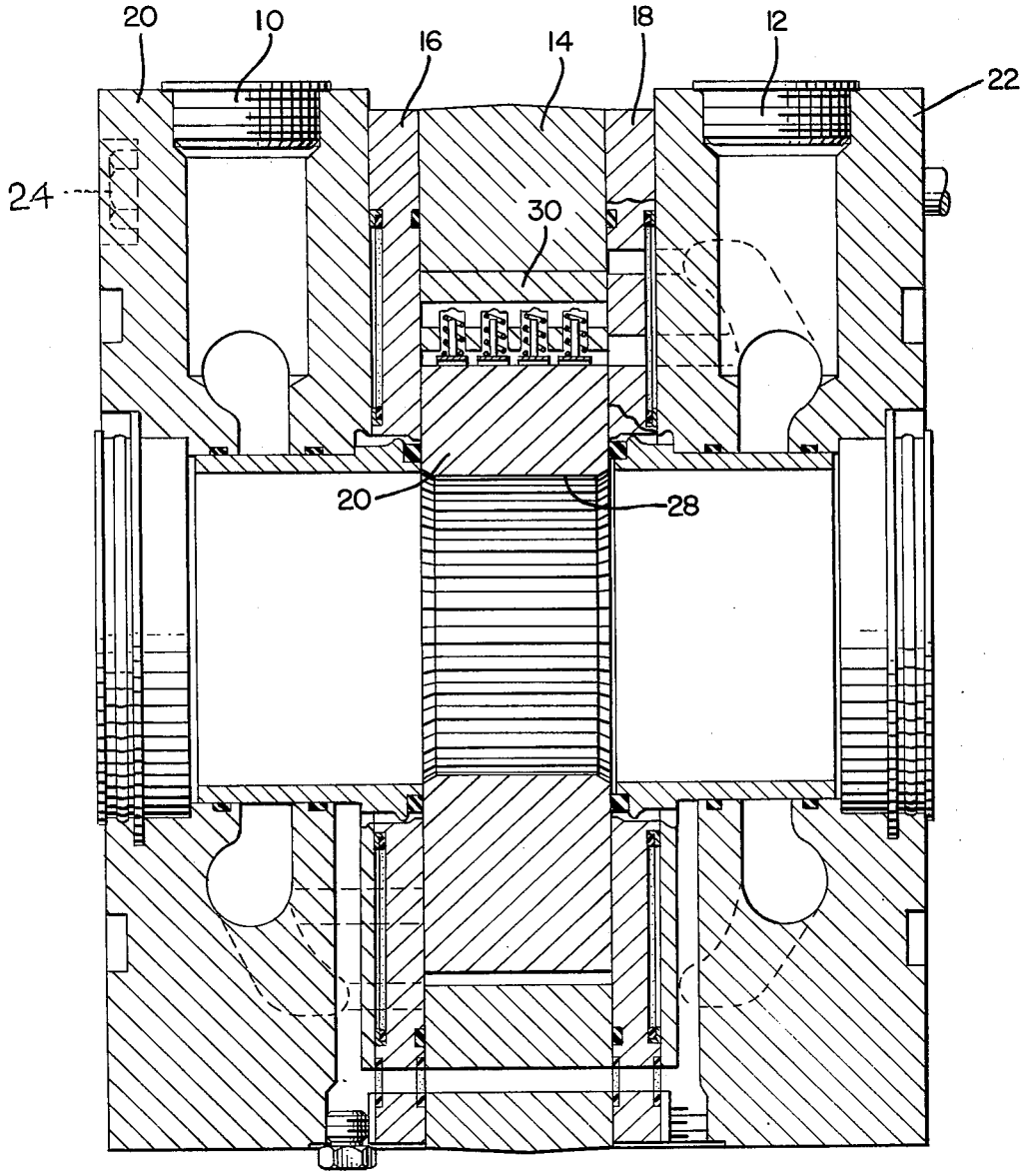
FIG. 1 is a longitudinal sectional view of a rotary sliding vane pump or motor incorporating a preferred form of the present invention.

Referring to FIG. 1, the device there illustrated may typically be used as a reversible fluid motor having terminals 10 and 12 which, when fluid under pressure is delivered to one or the other, the motor will be driven in one or the other direction. The body of the unit comprises a central cam ring 14, a pair of similar cheek plates 16 and 18 and a pair of similar end covers 20 and 22. These parts are all clamped together by bolts 24 at suitably placed points around the periphery of the end covers. The revolving group of the unit comprises a slotted rotor 26 having an internal spline 28 for the reception of a driven shaft, not shown, and a series of radially slidable vanes 30 which are spring-pressed outwardly against the internal cam surface of the cam ring 14. Such structures in general are well known in the art and reference may be made to U.S. Pat. No. 3,792,936 for further details.

Figure 2:
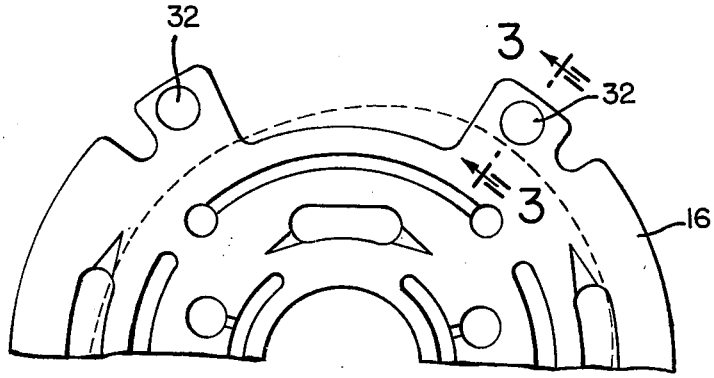
FIG. 2 is a fragmentary face view of a cheek plate incorporating one form of the present invention.
Figure 3:
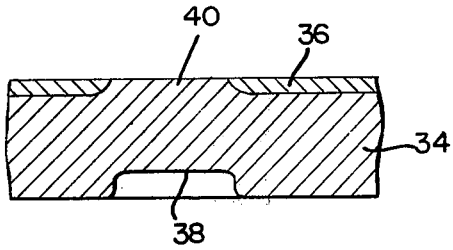
FIG. 3 is a cross section on line 3—3 of FIG. 2.

The present invention relates to the structure of the cheek plates 16 and 18 as used in such a pump or motor. Referring to FIGS. 2 and 3, a cheek plate construction incorporating one form of the present invention is there shown. The contour of a typical cam ring is illustrated in dotted lines assuming clockwise rotation of the rotor. Within the area of the cheek plate which lies radially outside the dotted line, there are provided one or more contact areas 32 formed of material having a long wearing characteristic under rubbing action. Such a construction may be conveniently provided by forming the cheek plate of a base material 34 such as mild steel and plating it with a layer of low-friction material 36 such as bronze. Preferably before plating, the backing plate 34 is deformed by a coining operation which produces a depression 38 and a raised portion 40. Thereafter, the wearing face of the cheek plate is machined to bring the raised portions 40 down to an even level with the wear face of the bronze plating 36. Subsequently, a localized heat treating operation such as case hardening may be applied to the area 40.

Figure 4:
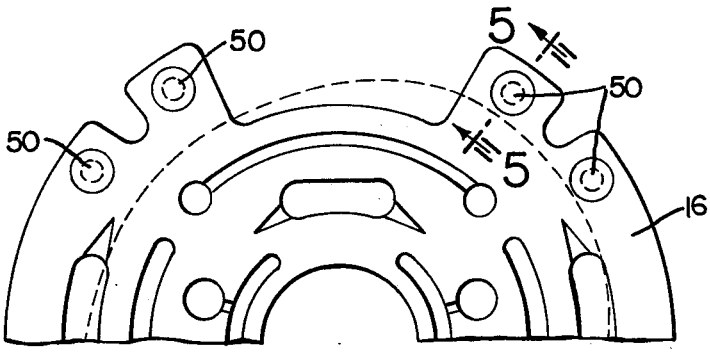
FIG. 4 is a fragmentary face view of a cheek plate incorporating a second form of the present invention.
Figure 5:
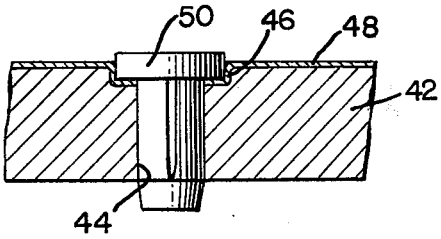
FIG. 5 is a sectional view along FIG. 5—5 illustrating conditions during a preliminary stage of the manufacture of the cheek plate.
Figure 6:
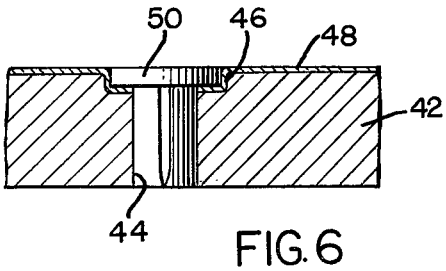
FIG. 6 is a view corresponding to FIG. 5 illustrating the finished cheek plate.

In the form of the invention illustrated in FIGS. 4, 5 and 6, a backing plate 42 is first machined to provide bores 44 having enlarged counterbores at 46. The plate is then given its bronze plating application and a hardened steel headed pin 50 is pressed into the bore 44 and counterbore 46. Thereafter, the cheek plate is machined on both sides to bring the face of the headed pin 50 level with the bronze plating surface 48. Thus, there is provided a plurality of areas such as 50 illustrated in FIG. 4 which will withstand prolonged rubbing caused by expansion and contraction of the cam ring and thus preserve for a much longer time the optimum clearance between the cheek plate and the rotary parts of the device. This form of the invention may also be used with a wear plate of solid low friction material such as bronze.

I claim:

1. A rotary sliding vane pump or motor having a body comprising a central cam ring having circular arcs of major and minor diameters alternately spaced around its inner cam surface and connected by ramps along which fluid displacement can occur, said body further comprising end covers, means forming inlet and outlet terminals connected respectively with the ramps, a slotted rotor within the cam ring and carrying radially slidable vanes to traverse the inner cam ring surface, one or more cheek plates interposed between one or both end covers and the rotor, the vanes, and the stationary cam ring, the cheek plate or plates having a wear face of bearing material abutting the rotor and vanes wherein the wear face is a layer of bearing material formed on a harder metal back, the back being deformed over discrete limited areas to provide wearresistent contacts with the cam ring, whereby the wear between the cheek plate and the cam ring as it radially expands and contracts under intermittent pressure loads is reduced.

2. A pump or motor as defined in claim 1 wherein the wear face is a bronze plating on a steel back and the area of contact is hardened steel.

* * * * *

UNITED STATES PATENT AND TRADEMARK OFFICE

CERTIFICATE OF CORRECTION

PATENT NO. : 4,072,451

DATED : February 7, 1978

INVENTOR(S) : Albin J. Niemiec

It is certified that error appears in the above-identified patent and that said Letters Patent are hereby corrected as shown below:

Cancel numeral "20" in central portion of Fig. 1 and insert numeral --26-- therefor.

Signed and Sealed this

*Fourth* Day of *December 1979*

[SEAL]

*Attest:*

SIDNEY A. DIAMOND

*Attesting Officer*

*Commissioner of Patents and Trademarks*